United States Patent [19]

Paasche et al.

[11] Patent Number: 5,002,433

[45] Date of Patent: Mar. 26, 1991

[54] SYSTEM FOR TRANSFERRING FLUIDS FROM A PIPING SYSTEM IN A SHIP'S HULL TO A TURNING DEVICE, AND VICE VERSA

[75] Inventors: George W. Paasche, Stjordal; Ketil Hanssen, Trondheim, both of Norway

[73] Assignee: Golar-Nor Offshore A.S, Trondheim, Norway

[21] Appl. No.: 442,090

[22] Filed: Nov. 28, 1989

[30] Foreign Application Priority Data

Nov. 28, 1988 [NO] Norway ..... 885305

[51] Int. Cl.[5] ..... B63B 35/00; E03B 17/00

[52] U.S. Cl. ..... 405/210; 166/355; 175/7

[58] Field of Search ..... 166/350, 355; 114/264, 114/265; 405/224, 210, 195; 175/7

[56] References Cited

U.S. PATENT DOCUMENTS

| | | | |
|---|---|---|---|
| 3,602,175 | 8/1971 | Morgan et al. | 175/7 X |
| 3,605,668 | 9/1971 | Morgan | 175/7 X |
| 4,519,728 | 5/1985 | Oshima et al. | 114/265 X |
| 4,701,143 | 10/1987 | Key et al. | 166/355 X |
| 4,753,553 | 6/1988 | Carlsen | 166/355 X |
| 4,841,895 | 6/1989 | Brewerton | 166/355 X |

*Primary Examiner*—Randolph A. Reese
*Assistant Examiner*—John A. Ricci
*Attorney, Agent, or Firm*—Dykema Gossett

[57] ABSTRACT

A system for transferring fluids from a piping system which is firmly connected with a ship's hull (2) to a turning device (5), and vice versa, in which the turning device is rotatably connected with said hull. The turning device has a through hole (7) coaxially with its axis of rotation, through which a drill string, a rigid riser, or the like may be run by the aid of a derrick (16). Furthermore, turning device is arranged for anchoring to the sea floor and connection with at least one flexible riser being connected with respective devices which are firmly connected with the sea floor, and with hoses which are connected with the piping system in the hull. According to the invention the turning device is connected with the piping system, via at least one swivel means (21,22) of a kind known per se, for each fluid, each swivel means having first and second mutually rotatable swivel members (24,25), between which fluids may be transferred during mutual rotation of the swivel members, first and second swivel members (24, 25) of swivel means (21, 22) being substantially non-rotatably connected with turning device (5), and hull (2), respectively.

6 Claims, 1 Drawing Sheet

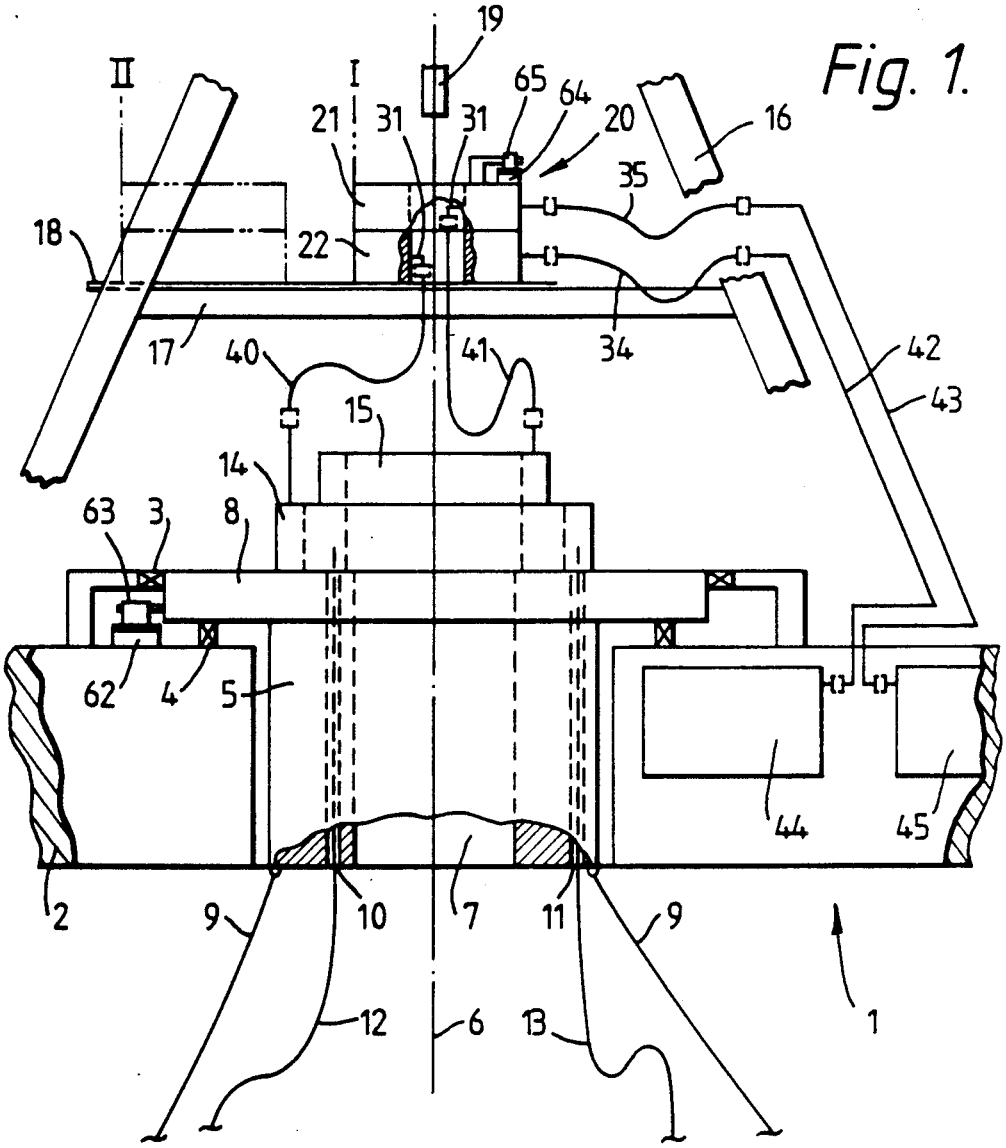
Fig. 2.
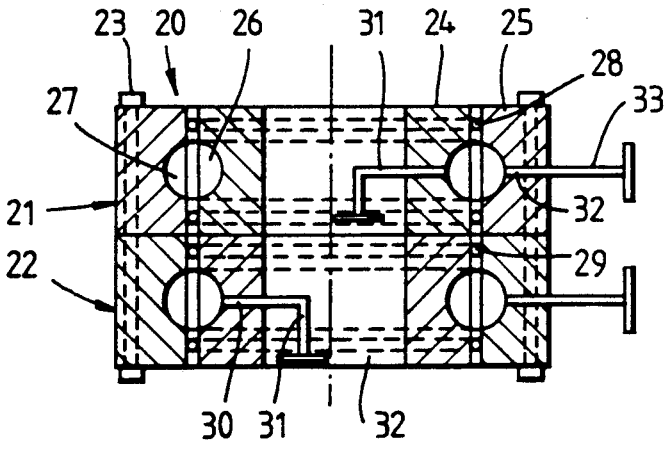

SYSTEM FOR TRANSFERRING FLUIDS FROM A PIPING SYSTEM IN A SHIP'S HULL TO A TURNING DEVICE, AND VICE VERSA

The invention relates to a system for transferring fluids from a piping system which is firmly connected to a ship's hull to a turning device, and vice versa, where the turning device is rotatably connected with said hull and arranged for being anchored to the sea floor, and connection with at least one flexible riser, which is connected with respective devices being firmly connected with the sea floor, and with hoses connected with the piping system in the hull, the turning device having a through hole coaxially with the axis of rotation, through which are drill, a rigid riser, or a similar string may be run by the aid of a derrick. Systems of this kind are used during production of oil and gas from offshore fields. During such production, the ship could, optionally, be firmly anchored on the sea floor, being all the time maintained lying above the gas or oil well with its longitudinal axis being directed the same way. The high forces to which anchoring means are subjected when a vessel lies across the wind and wave direction, however, makes such anchoring difficult. This is avoided by, in stead, anchoring the vessel, via a turning device or turntable which is provided substantially midship and can turn about a vertical axis relative to the ship's hull, and which is firmly anchored to the sea floor, e.g. by the aid of chains extending radially away from the turntable and down to the sea floor, so that the turntable may not rotate about its vertical axis relative to the sea floor. The vessel is, thus, made vane stable, i.e. it will automatically seek to find a position with its bow against the direction of the wind. For transfer of oil and gas from the wells to the tanks in the hull flexible risers are provided, which connects the wells with the turntable, as well as hoses which permanently connect the turntable with the tanks, said hoses being wound about the turntable during the ship's turning movement due to varying winds. Due to the large diameter of the turntable (about 25 m), and the weight and diameter of the hoses the length of hoses is limited which will, in turn, limit the total mutual rotation of the turntable and the hull to approximately 360°. If the vessel has carried out approximately said rotation and if weather conditions will probably cause further turning, the vessel has to be turned in the opposite direction, e.g. by the aid of a thruster, to unwind the hoses from the turntable. During such operations the vessel will temporarily be lying with its broadside against the direction of the wind. Since the vessel is connected with the wells and production is in progress during the turning operation, this maneuver is, obviously, very hazardous, especially if waves and wind velocity are high.

It is an object of the invention to provide a system of the kind as mentioned above, which is not burdened with the above disadvantages.

The system according to the invention is characterized as will appear from the features stated in the claims.

The invention is disclosed in more detail below with reference to the drawings, showing an embodiment of a system according to the invention. In the drawings FIG. 1 is a diagrammatical side elevation of a portion of a vessel that is anchored to the sea floor comprising a system according to the invention;

FIG. 2 shows a longitudinal section through a swivel mounting.

In FIG. 1 a vessel 1 is shown, in the hull 2 of which a turning device or turntable 5 is mounted, via bearings 3,4, so that the turntable may rotate about a vertical axis 6. Turntable 5 has a through opening extending coaxially with axis 6, and an annular upper portion 8. By the aid of chains 9 or the like the turntable is anchored to the sea floor, so that it cannot rotate relative to the latter.

Through two axially extending through holes 10,11 in turntable 5 respective flexible risers 12, 13 extend from oil wells (not shown) to two associated, e.g. annular manifolds 14, 15, which are mounted coaxially on upper portion 8 of the turntable.

Above the turntable a derrick 16 is firmly secured to hull 2 and comprises horizontal beams 17 on which rails 18 may be secured. Two swivel means 21, 22 are mounted slidably on rails 18. A rigid riser 19 is provided coaxially with the turntable and is raisable and lowerable in the derrick.

As will appear from FIG. 2, each swivel means 21, 22 is annular and comprises an inner member 24 and an outer member 25, said outer member 25 being provided radially outside and coaxial with inner member 24. Said members have grooves 26, 27 facing each other and forming an annular chamber or a toroidal chamber. Gaskets 28, 29 are provided between inner member 24 and outer member 25 to seal off the toroidal chamber. From groove 26 in the inner annular member a channel 30 extends radially inwards and communicates with a pipe 31 which projects into the central opening 32 of the member. Correspondingly, a channel 36 extends radially outwards from the groove 27 in the outer ring. This channel 36 communicates with a pipe 33 extending radially outwards.

As shown in FIG. 2, swivel means 21, 22 may be firmly connected by the aid of screws 23, so that the swivel means together form a swivel assembly 20, and so that the outer portions can rotate as a unit relative to the inner portions.

Swivel assembly 20 is displaceable in a transversal direction on rails 18 between a first position in which it is coaxial with turntable 5, and a second position in which its projection in the axial direction substantially does not overlap opening 7 in turntable 5, as indicated by I and II in FIG. 1.

The pipe 31 of the inner member 24 of the lower swivel means 22 is connected with the outer manifold 14, via a hose 40, and the pipe 33 of the outer member 25 of the swivel member 22 is connected with a tank 44, via a pipe 42, and a hose 34. Correspondingly, the pipe 31 of the inner member 24 of the upper swivel means 21 is connected with the inner manifold 15, via a hose 41, and the pipe 33 of the outer member 25 of said swivel means 21 is connected with a tank 45, via a pipe 43 and a hose 35.

Coaxially with the turntable 5 and close to the latter a toothed ring 62 may be provided, which is firmly connected with hull 2, and a toothed wheel 63 engaged with said toothed ring may be rotatably mounted on turntable 5. On top of outer member 25 of upper member of swivel assembly 20 a toothed ring may likewise, be coaxially provided and engaged with a toothed wheel 65, which is rotatably connected with the inner member. The toothed wheels 63, 65 may be mutually connected by the aid of, e.g. a flexible shaft 37 or, via hydraulic hoses 69(*a*) and 69(*b*) and combined hydraulic pump 70/motor means 71, which are connected with the toothed wheels so that the mutual position of inner the inner and outer members of the swivel assembly always correspond to the mutual position of the turntable and the hull. In stead of toothed wheels and toothed rings other means, e.g. electromotors, may be provided for mutual rotation of the members of swivel assembly.

There are two applications of the system according to the invention.

Application 1. Normal production

In this application the swivel assembly 20 is in its first position, as indicated by I in FIG. 1. Well fluid, e.g. oil flows up through risers 12, 13, and into manifolds 14, 15. From here, the oil flows through hoses 40, 41 to the lower or upper swivel means, respectively, of swivel assembly 20, and onto tanks 44, 45, via pipes 42, 43.

In case of changing directions of wind during this application the hull may turn freely relative to the turntable, and the hoses 40, 41 will not be twisted together, but maintain their mutual position.

Application 2. Simple well maintenance

When this kind of maintenance is to be carried out, the swivel assembly 20 is displaced from its first position I to its second position II, so that, e.g. a rigid riser may be lowered from derrick 16 through the turntable 5. Even though the swivel assembly 20 is displaced, the internal rings are turned corresponding to the mutual displacement between the turntable and hull, so that there is no hazard of hoses 40, 41 being twisted in case of this application. The reason why, e.g. upper portion 8 of turntable 5 is not designed as a swivel unit, rendering the swivel assembly 20 redundant, is that there are great difficulties in connection with mutual sealing of large swivel members. The swivel assembly 20, the outer diameter of which must not exceed approximately 1.5 m due to this fact, however, prevents a rigid riser or a drill string from being run through central through opening 32, this opening partly being blocked by the pipes. With the slidable arrangement of swivel assembly this kind of well maintenance may readily be carried out without any interruption of production.

The system was disclosed above in connection with a swivel assembly comprising two swivel members for fluids, which may flow from an inlet to an outlet placed radially inside, or outside, respectively. The assembly may, obviously, comprise only one swivel member or a plurality of such members. Additionally, this assembly may comprise a member provided on top of said swivel members, where the fluid flows axially.

What we claim is:

1. A system for transferring fluids from one piping system which is firmly connected with a ship's hull (2) to a turning device, and vice versa, with said turning device being rotatably connected with the hull and designed for being anchored to the sea floor, and for connection with at least one flexible riser (12, 13) connected with respective means which are firmly connected with the sea floor and with hoses (40, 41, 42, 43) which are connected with the piping system in the hull, said turning device having a through hole (7) which is coaxial with the axis of rotation, through which a drill string, a rigid riser, or the like (19) may be run by the aid of a derrick (16), wherein the turning device (5) is connected with the piping system (42, 43), via at least one swivel means (21, 22) for each fluid, where each swivel means has first and second mutually rotatable swivel members (24, 25), between which fluids may be transferred during mutual rotation of the swivel members, the first and second swivel members (24, 25) of the swivel means (21, 22) being substantially non-rotatably connected with the turning device (5), or the hull (2), respectively, wherein the swivel means (21, 22) are displaceable between a position (I) in which they are positioned on top of the turning device (5) with the axis of rotation of the swivel means (21, 22) substantially coinciding with the axis of rotation of the turning device (5), and a second position (II), in which the projection of the hole (7) of the turning device (5) substantially is not in contact with the projection of the swivel means (21, 22), the direction of projection being parallel with the axes of rotation.

2. A system according to claim 1 where the swivel means (21, 22) are arranged with coinciding axes of rotation, and that they are mutually firmly connected and together form a swivel assembly (20).

3. A system according to claim 1 wherein the swivel means (21, 22) are provided to be slidable along rails (18) which are attached to a derrick (16), which is mounted on the hull (2) above the turning device (5).

4. A system according to claim 1 wherein the non-rotational connection between the turning device (5) and the first swivel members (24) comprises a toothed ring (62), which is provided along the periphery of the turning device (5) and is firmly connected with the hull (2), and a toothed ring (64) which is provided coaxially and is firmly connected with the second swivel members (25), and two toothed wheels (63, 65), which engage the respective toothed rings (62, 64) and are rotatably mounted on the turntable (5), or the first swivel members (24), respectively, said toothed wheels being mutually connected, so that rotation of the hull in one direction relative to the turning device will cause simultaneous turning of the first swivel means for a corresponding angular distance in the other direction relative to the second swivel member.

5. A system according to claim 4 wherein the mutual connection between the toothed wheels consists of a flexible shaft.

6. A system according to claim 4 wherein the toothed wheel (63) which is in engagement with the toothed ring (62) which is provided along the periphery of the turning device (5), is driving a hydraulic pump (70), and that the toothed wheel (65) which is in engagement with the toothed ring (64) which is connected with the second swivel member (25) is driven by a hydraulic motor (71), the hydraulic motor and pump being connected with each other through hydraulic hoses (69*a, b*).

* * * * *